US010938143B2

(12) United States Patent
Ito et al.

(10) Patent No.: US 10,938,143 B2
(45) Date of Patent: Mar. 2, 2021

(54) CONNECTOR WITH CONTACT PIN HAVING MULTIPLE SEALS FOR IMPLEMENTING INSULATION AND MOISTURE PROOFING

(71) Applicant: Molex, LLC, Lisle, IL (US)

(72) Inventors: Naotoshi Ito, Yamato (JP); Shigeru Akiyama, Yamato (JP); Tomonari Kaneko, Yamato (JP); Hiroki Kobayashi, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/548,874

(22) Filed: Aug. 23, 2019

(65) Prior Publication Data

US 2020/0136303 A1 Apr. 30, 2020

(30) Foreign Application Priority Data

Oct. 31, 2018 (JP) ..... JP2018-204652

(51) Int. Cl.

| | |
|---|---|
| ***H01R 13/52*** | (2006.01) |
| ***H01R 13/04*** | (2006.01) |
| ***H01R 13/41*** | (2006.01) |
| *H01R 12/75* | (2011.01) |
| *H01R 12/57* | (2011.01) |
| *H01R 12/58* | (2011.01) |

(52) U.S. Cl.

CPC ..... *H01R 13/521* (2013.01); *H01R 13/04* (2013.01); *H01R 13/41* (2013.01); *H01R 12/57* (2013.01); *H01R 12/58* (2013.01); *H01R 12/75* (2013.01)

(58) Field of Classification Search

CPC ..... H01R 13/521; H01R 13/04; H01R 13/41; H01R 12/57; H01R 12/58; H01R 12/75

USPC ..... 439/78

See application file for complete search history.

(56) References Cited

U.S. PATENT DOCUMENTS 4,464,007 A * 8/1984 Parmer ..... H01R 12/585 439/389
4,645,278 A * 2/1987 Yevak, Jr. ..... H01R 13/447 228/212
4,941,847 A * 7/1990 Welsh ..... H01R 13/41 439/589

(Continued)

FOREIGN PATENT DOCUMENTS

CN 101904054 A 12/2010
CN 104979691 A 10/2015

(Continued)

*Primary Examiner* — Peter G Leigh

(57) ABSTRACT

A connector includes: a terminal, and a housing holding the terminal, the connector being mounted on a substrate with a liquid potting agent applied thereto, wherein: the housing includes a mating recess mating with a counterpart connector, along with a bottom plate part in which a terminal press-in hole with the terminal pressed therein is formed, the terminal includes a contact part contacting a counterpart terminal of the counterpart connector in the mating recess, a substrate connection part which is exposed below the bottom plate part so as to be connected to the substrate, and a holding part housed and held in the terminal press-in hole, and this holding part includes a terminal side first seal part and a terminal side second seal part which respectively configure a first seal part and a second seal part by adhering to the side faces of the terminal press-in hole.

22 Claims, 13 Drawing Sheets

(56) References Cited

U.S. PATENT DOCUMENTS 4,978,308 A * 12/1990 Kaufman ..... H01R 12/714 439/78
5,263,880 A * 11/1993 Schwarz ..... H01R 13/405 174/538
5,346,413 A * 9/1994 Leon ..... H01M 2/20 439/733.1
5,460,549 A * 10/1995 Muzslay ..... H01R 13/521 439/347
5,489,221 A * 2/1996 Fujiura ..... H01R 13/41 439/733.1
5,571,033 A * 11/1996 Kinsey, Jr. ..... H01R 13/41 439/444
5,885,113 A * 3/1999 Bricaud ..... H01R 13/41 439/733.1
5,980,271 A * 11/1999 MacDougall ..... H01R 13/41 439/733.1
5,989,075 A * 11/1999 Hsiao ..... H01R 13/41 439/444
6,328,576 B1 * 12/2001 Takahashi ..... H01R 13/41 439/733.1
6,375,507 B1 * 4/2002 Van Koetsem .... H01R 13/6599 439/607.02
6,811,449 B2 * 11/2004 Yamashita ..... H01R 13/41 439/733.1
7,083,478 B1 * 8/2006 Kutsuna ..... H01R 13/41 439/733.1
7,125,285 B2 * 10/2006 Maejima ..... H01R 12/523 439/82
7,458,148 B2 * 12/2008 Matsumura ..... H01R 43/20 29/837
8,197,264 B1 * 6/2012 Eakins ..... H01R 12/57 439/83
8,210,856 B2 * 7/2012 Suzuki ..... H01R 12/585 439/733.1
8,444,444 B2 * 5/2013 Kitajima ..... H01R 13/521 439/751
9,142,905 B2 * 9/2015 Yu ..... H01R 13/4367
9,537,278 B2 * 1/2017 Kawagishi ..... H01R 43/22
9,608,363 B2 * 3/2017 Greene ..... H01R 43/20
9,812,798 B2 * 11/2017 Yu ..... H01R 12/57
9,876,303 B2 * 1/2018 Suemitsu ..... H01R 13/41

FOREIGN PATENT DOCUMENTS

EP 0455297 A1 11/1991
EP 1562262 A2 8/2005
JP S6-079074 U 6/1985
JP S61-206275 U 12/1986
JP 2580865 Y2 9/1998
JP 2016-201312 A 12/2016
JP 6143384 B2 6/2017
JP 2017-130256 A 7/2017

* cited by examiner

Prior art

CONNECTOR WITH CONTACT PIN HAVING MULTIPLE SEALS FOR IMPLEMENTING INSULATION AND MOISTURE PROOFING

RELATED APPLICATIONS

This application claims priority to Japanese Application No. 2018-204652, filed on Oct. 31, 2018, which application is incorporated herein by reference in its entirety.

TECHNICAL FIELD

The present disclosure relates to a connector.

BACKGROUND ART

Conventionally, in a connector mounted on a substrate such as a circuit substrate, in order to prevent flux (used to improve the wettability of solder) from rising along the surface of a terminal when connecting and fixing the terminal to a connection pad of the substrate via soldering, a technique is proposed of adhering a press-in part of the terminal (formed in a housing of the connector) to the periphery of the terminal (for example, see Patent Document 1).

FIG. 13 is a cross-sectional view illustrating a holding part of a terminal in a conventional connector.

In the figure, 811 is a housing of the connector, 812 is a bottom plate of the housing 811, and 813 is a terminal press-in hole, which is a through hole penetrating through the bottom plate 812. Moreover, 851 is a terminal mounted on the connector, in addition to being held to the bottom plate 812 when a holding part 853 is pressed into the terminal press-in hole 813. In addition, a substrate connection part 852, formed at the lower end of a terminal 851 protruding downward from the bottom plate 812, is inserted into a through hole 892 formed in a substrate 891 such as a circuit substrate, then electrically connected to the through hole 892 via soldering and fixed.

Here, the dimensions inside a lower inner wall 815 of the terminal press-in hole 813 are set to be smaller than the dimensions outside the holding part 853 of the terminal 851. Consequently, the entire periphery of the holding part 853 is adhered to the lower inner wall 815, making it possible to prevent flux (which rises via the substrate connection part 852) from reaching the upper end of the terminal 851.

Patent Document 1: JP 6-079074 Y

SUMMARY

Unfortunately, in the conventional connector, even if a small amount of flux can be prevented from rising, a potting agent applied to the surface of the substrate 891 cannot be effectively prevented from rising. In order to implement insulation and moisture proofing, the surface of the substrate 891 such as a circuit substrate is covered with a potting agent consisting of a resin such as urethane. The potting agent is generally applied in a liquid state, then cured. As a result, the periphery of the bottom plate 812 in the housing 811 of the connector mounted on the surface of the substrate 891 is surrounded by a large amount of the liquid potting agent, thereby increasing the possibility of the potting agent passing between the holding part 853 and the terminal press-in hole 813 of the terminal 851 and rising.

Here, in order to solve the problem of the conventional connector, an object is to provide a connector which has a small, simple configuration, wherein a potting agent can be assuredly prevented from passing and rising between a holding part of a terminal and a terminal press-in hole of a bottom plate part and being attached to a contact part of the terminal.

Therefore, a connector includes: a terminal, and a housing holding the terminal, the connector being mounted on a substrate with a liquid potting agent applied thereto, wherein: the housing includes a mating recess mating with a counterpart connector, along with a bottom plate part in which a terminal press-in hole with the terminal pressed therein is formed, the terminal includes a contact part contacting a counterpart terminal of the counterpart connector in the mating recess, a substrate connection part which is exposed below the bottom plate part so as to be connected to the substrate, and a holding part housed and held in the terminal press-in hole, and this holding part includes a terminal side first seal part and a terminal side second seal part which respectively configure a first seal part and a second seal part by adhering to the side faces of the terminal press-in hole.

Further, in another connector, the holding part includes an anchor part which includes a protrusion part that bites the side faces of the terminal press-in hole between the first seal part and the second seal part.

Further, in yet another connector, the terminal side first seal part and the terminal side second seal part are held in the terminal press-in hole by interference fitting.

Further, in yet another connector, the bottom plate part includes a reservoir of the potting agent formed on the top surface thereof.

Further, in yet another connector, the terminal side first seal part has smaller dimensions in the width direction and the thickness direction than those of the terminal side second seal part, with the holding part pressed into the terminal press-in hole from upward to downward.

Further, in yet another connector, the first burr housing part is formed so as to be adjacent to the upper end of the first seal part, while the second burr housing part is formed so as to be adjacent to the upper end of the second seal part.

Further, in yet another connector, the terminal side first seal part has larger dimensions in the width direction and the thickness direction than those of the terminal side second seal part, with the holding part pressed into the terminal press-in hole from downward to upward.

Further, in yet another connector, the first burr housing part is formed so as to be adjacent to the lower end of the first seal part, while the second burr housing part is formed so as to be adjacent to the lower end of the second seal part.

A connector assembly includes the connector and a counterpart connector which mates with the connector.

The present disclosure provides a connector which has a small, simple configuration, wherein a potting agent can be assuredly prevented from passing and rising between a holding part of a terminal and a terminal press-in hole of a bottom plate part and being attached to a contact part of the terminal.

BRIEF DESCRIPTION OF DRAWINGS

FIGS. 3A and 3B are two-sided views of the substrate connector according to Embodiment 1, wherein FIG. 3A is a plan view, while FIG. 3B is a front view.

FIGS. 5A and 5B are side cross-sectional views of the substrate connector according to Embodiment 1, wherein FIG. 5A is a cross-sectional view in the arrow direction along line B-B in FIG. 3A, while FIG. 5B is an enlarged view of portion C in FIG. 5A.

FIGS. 6A-6C are three sided views of a terminal of the substrate connector according to Embodiment 1, wherein FIG. 6A is a front view, FIG. 6B is a side view, and FIG. 6C is a cross-sectional view in the arrow direction along line D-D in FIG. 6A.

FIGS. 9A and 9B are two sided views of the substrate connector according to Embodiment 2, wherein FIG. 9A is a plan view, while FIG. 9B is a front view.

FIGS. 10A and 10B are transverse cross-sectional views of the main parts of the substrate connector according to Embodiment 2, wherein FIG. 10A is a cross-sectional view in the arrow direction along E-E in FIG. 9A, while FIG. 10B is an enlarged view of portion Gin FIG. 10A.

FIGS. 12A-12C are three sided views of a terminal of the substrate connector according to Embodiment 2, wherein FIG. 12A is a side view, FIG. 12B is a front view, and FIG. 12C is a cross-sectional view in the arrow direction along line H-H in FIG. 12A.

DETAILED DESCRIPTION OF THE PREFERRED EMBODIMENTS

An embodiment will be described in detail below with reference to the drawings.

Figure 1:
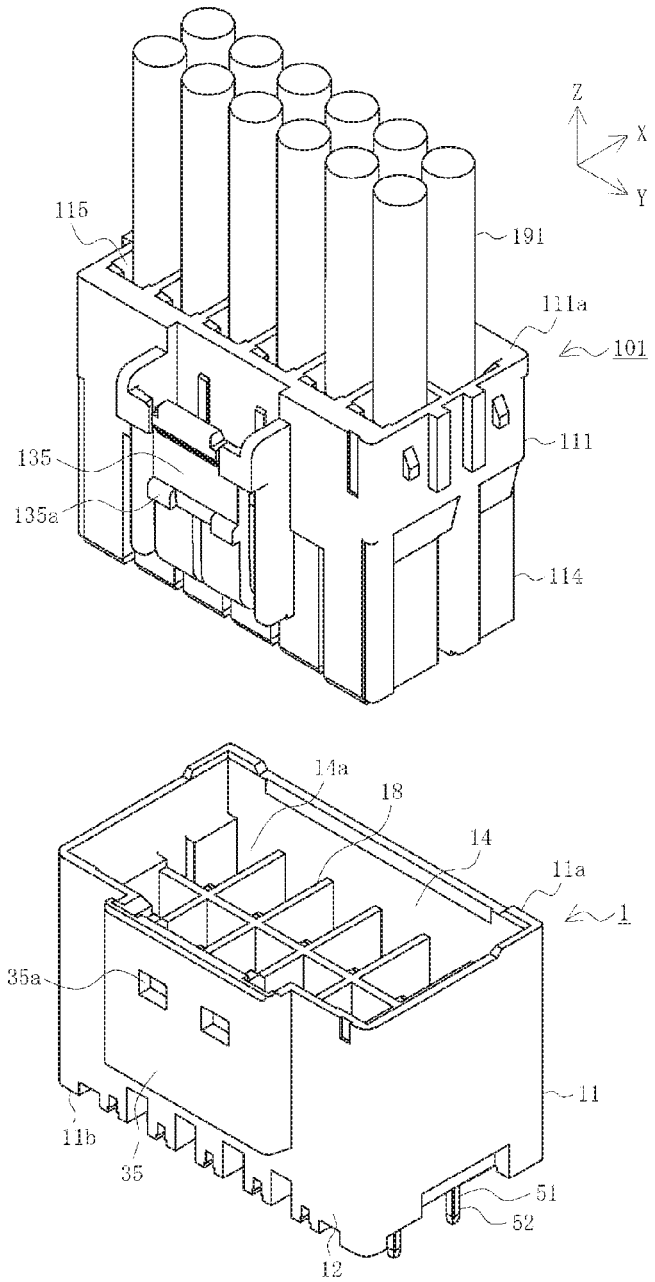
FIG. 1 is a perspective view illustrating the state prior to mating a substrate connector and an electric wire connector according to Embodiment 1.

FIG. 1 is a perspective view illustrating the state prior to mating a substrate connector and an electric wire connector according to Embodiment 1.

In the figure, as a connector in the present embodiment, 1 is a substrate connector which is a connector mounted on the surface of a substrate such as a circuit substrate (not illustrated). Moreover, as a counterpart connector in the present embodiment, 101 is an electric wire connector which is a connector connected to the terminals of multiple electric wires 191. While the substrate connector 1 and the electric wire connector 101 are used as one set in a variety of equipment such as electronic equipment, electric equipment, household equipment, medical equipment, industrial equipment, and transport equipment, and which may be used in any application; however, for convenience of description, they are used in electronic equipment and electric equipment.

As illustrated in FIG. 1, the multiple electric wires 191 are arranged in pairs so as to form two rows extending in the longitudinal direction (Y axis direction) of the substrate connector 1, then connected to the electric wire connector 101. In the example illustrated in the figure, the number of electric wires 191 is six in each row, giving a total of 12, but may be changed as desired. Note that the substrate connector 1 is a so-called straight type connector which is mounted while erected on the substrate, that is, opened upward (in the Z axis positive direction). In addition, the electric wire connector 101 vertically mates with the substrate connector 1, with the electric wires 191 thereby drawn out to the substrate in the vertical direction (Z axis direction). Moreover, the surface of the substrate is covered with a potting agent consisting of a resin such as urethane. This potting agent is applied to the surface of the substrate in a liquid state, then processed (for example, heated) so as to be cured, such that the substrate mounted on the surface of the substrate connector 1 is surrounded by a large amount of the liquid potting agent.

Note that expressions indicating directions, such as up, down, left, right, front, and back, used to describe the operations and configurations of the parts of the board-side connector 1 and the wire connector 101 in the present embodiment do not indicate absolute directions but rather relative directions. The expressed directions are relevant when the board-side connector 1 and the wire connector 101 are in their respective orientations illustrated in the figures. In the event these orientations change, these directions should be interpreted differently in accordance with the new orientations after the change.

The electric wire connector 101 has a counterpart housing 111 which is integrally formed of an insulating material such as synthetic resin so as to mate with the substrate connector 1. In addition, this counterpart housing 111 is a substantially rectangular parallelepiped box shaped member extending in the width direction of the substrate connector 1, with the downward (Z axis negative direction) side thereof serving as a mating part 114 fitted in a mating recess 14 of the substrate connector 1. Moreover, the counterpart housing 111 has multiple terminal housing holes 115 each housing a counterpart terminal (not illustrated) connected to the tip of each electric wire 191. The terminal housing holes 115 are through holes penetrating through the counterpart housing 111 from a top surface 111*a* of the counterpart housing 111 to the lower surface of the mating part 114 in the Z axis direction and are arranged so as to form two rows extending in the longitudinal direction (Y axis direction) of the counterpart housing 111. In addition, the counterpart terminal connected to the tip of each electric wire 191 is inserted into each terminal housing hole 115 from the top surface 111*a* side. Further, a cantilevered engagement arm part 135 (with the lower end thereof connected to the counterpart housing 111 and with the upper end thereof serving as a free end) is integrally formed on the side face on the front face side of the counterpart housing 111. Note that this engagement arm part 135 has engagement protrusions 135*a*.

The substrate connector 1 has a housing 11 which is integrally formed of an insulating material such as a synthetic resin and mates with the wire connector 101, along with terminals 51 consisting of metal bar shaped members which are attached so as to penetrate through a bottom plate part 12 of this housing 11. The housing 11 is a substantially rectangular parallelepiped box shaped member extending in the longitudinal direction of the substrate connector 1, in addition to including the mating recess 14 with a top surface 11*a* thereof opened, with the lower surface 11*b* thereof facing the surface of the substrate. The mating recess 14 is a part with the mating part 114 of the electric wire connector 101 fitted therein and is divided into multiple terminal housing sections 14*a* integrally formed in the housing 11 via partition walls 18. The terminal housing sections 14*a* are arranged so as to form two rows extending in the longitudinal direction (Y axis direction) of the housing 11 to correspond to the terminal housing holes 115 of the counterpart housing 111. In addition, each terminal housing section 14*a* is housed in each terminal 51. Moreover, an engagement swollen part 35 with which the engagement arm part 135 of the counterpart housing 111 enters to engage is formed on the side face on the front face side of the housing 11, while engagement openings 35*a* which engage with the engagement protrusions 135*a* of the engagement arm part 135 are formed on the wall surface of this engagement swollen part 35. Note that a substrate connection part 52 of each terminal 51 is a part which protrudes downward (in the Z axis negative direction) from the bottom plate part 12 and is inserted into the through hole formed on the surface of a substrate (not illustrated) so as to be electrically connected via soldering, etc.

In addition, the mating part 114 of the electric wire connector 101 is fitted in the mating recess 14 of the substrate connector 1 so as to mate the electric wire connector 101 and the substrate connector 1, with each terminal 51 of the terminal housing section 14*a* contacting the counterpart terminal in the corresponding terminal housing hole 115.

Next, the configuration of the substrate connector 1 will be described below in detail.

Figure 2:
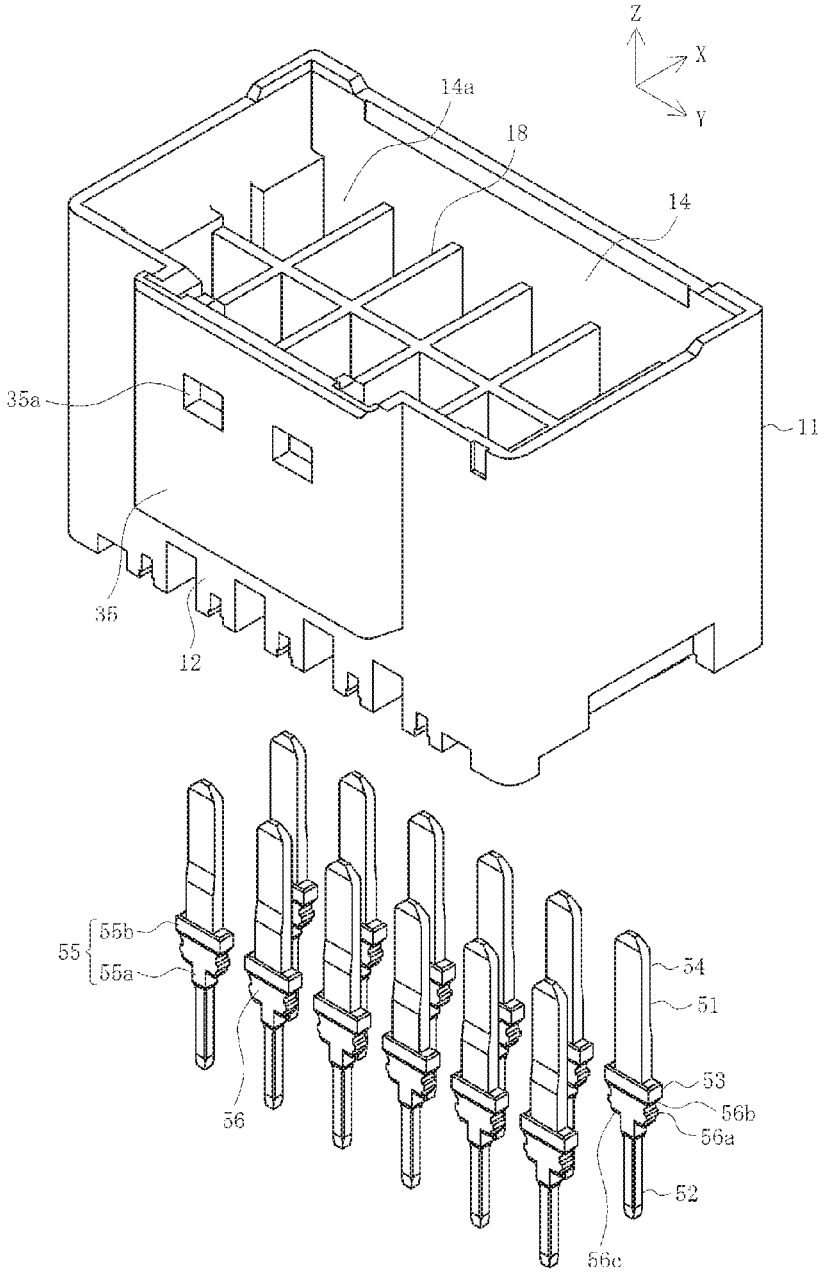
FIG. 2 is an exploded view of the substrate connector according to Embodiment 1.
Figure 3A:
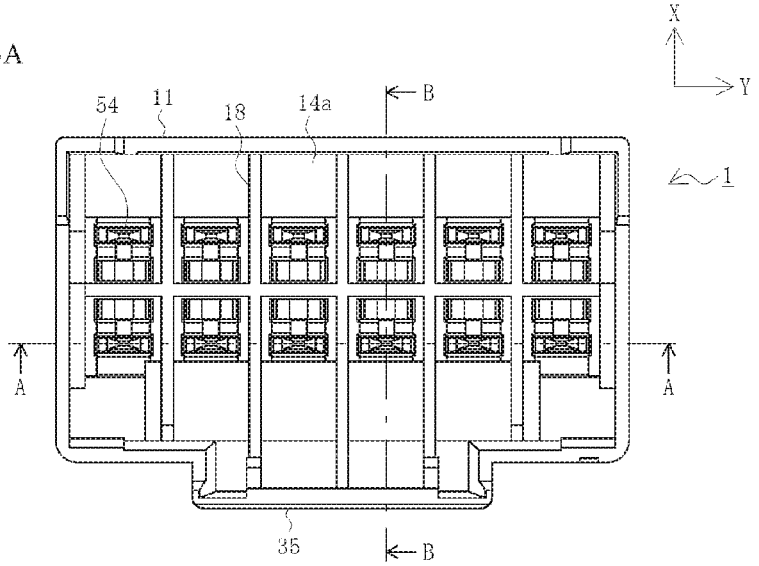
Figure 3B:
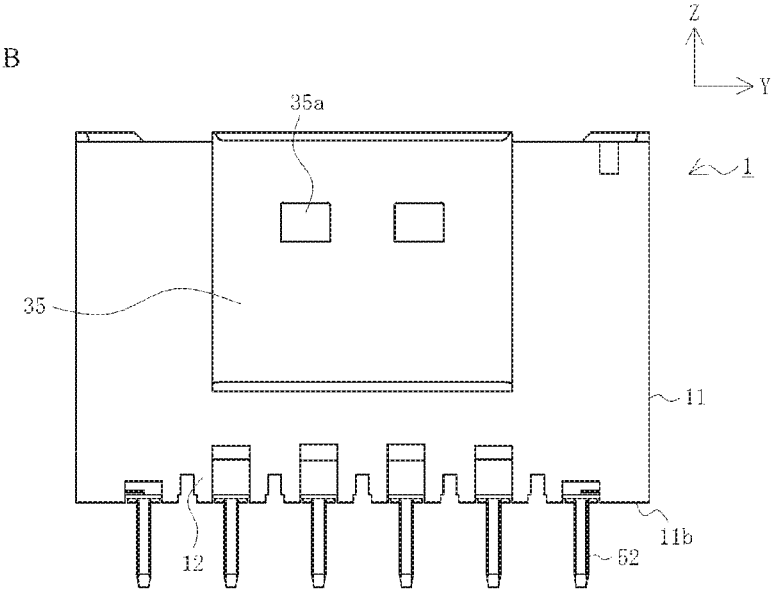
Figure 4:
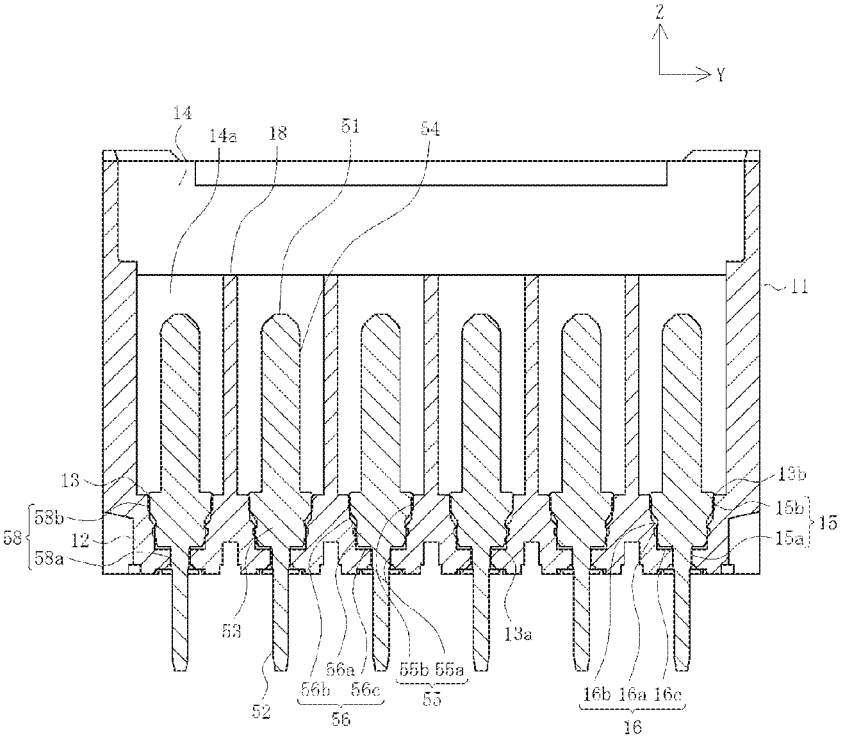
FIG. 4 is a transverse cross-sectional view of the substrate connector according to Embodiment 1 and is a cross-sectional view in the arrow direction along A-A in FIG. 3A.
Figure 5A:
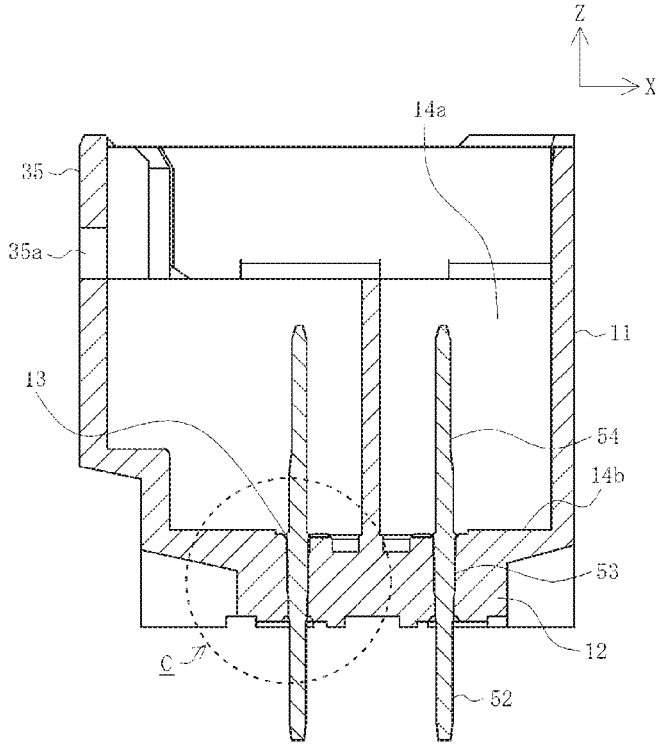
Figure 5B:
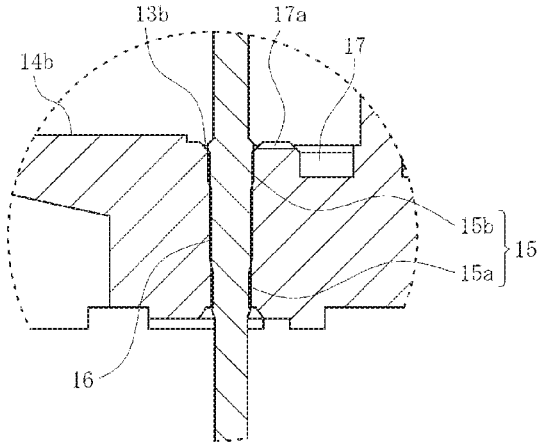
Figure 6C:
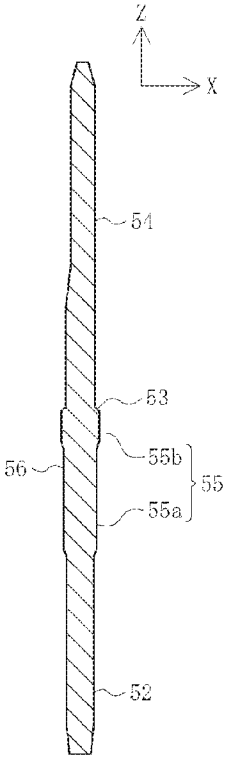
Figure 6B:
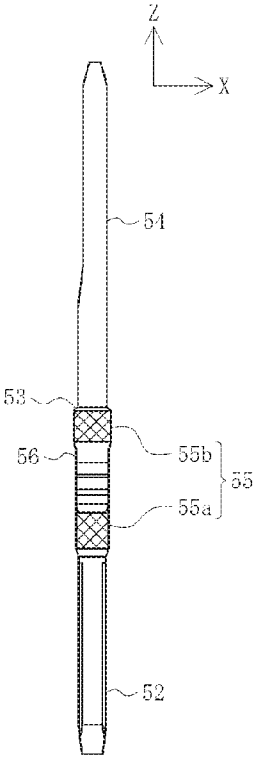
Figure 6A:
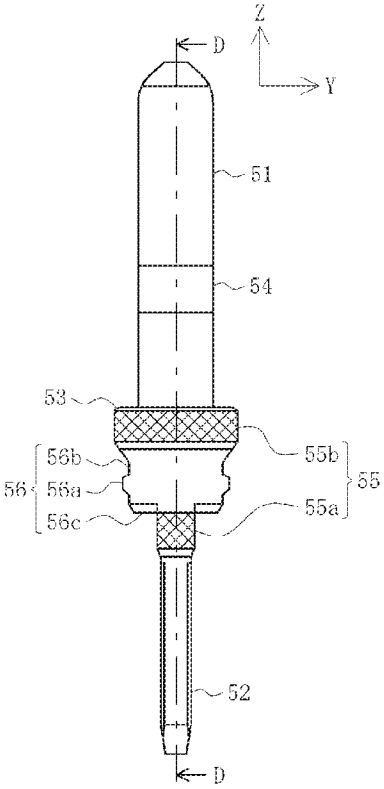

FIG. 2 is an exploded view of the substrate connector according to Embodiment 1, FIGS. 3A and 3B are two sided views of the substrate connector according to Embodiment 1, FIG. 4 is a transverse cross-sectional view of the substrate connector according to Embodiment 1 and is a cross-sectional view in the arrow direction along A-A in FIG. 3A, FIGS. 5A and 5*b* are side cross-sectional views of the substrate connector according to Embodiment 1, and FIGS. 6A-6C are three sided views of a terminal of the substrate connector according to Embodiment 1. Note that in FIGS. 3A and 3B, FIG. 3A is a plan view, while FIG. 3B is a front view, in FIGS. 5A and 5B, FIG. 5A is cross-sectional view in the arrow direction along line B-B in FIG. 3A, while FIG. 5B is an enlarged view of portion C in FIG. 5A, and in FIGS. 6A-6C, FIG. 6A is a front view, FIG. 6B is a side view, and FIG. 6C is a cross-sectional view in the arrow direction along line D-D in FIG. 6A.

The terminal 51 is a linear member formed by processing a metal material via punching, pressing, etc., in addition to having a holding part 53 held by the bottom plate part 12 of the housing 11, a contact part 54 stretching linearly upward from the upper end of this holding part 53, and a substrate connection part 52 stretching linearly downward from the lower end of the holding part 53. As illustrated in FIGS. 4, 5A and 5B, the holding part 53 is a part which is pressed into a terminal press-in hole 13 formed at the bottom plate part 12 and held. In addition, in each terminal housing section 14*a*, the contact part 54 is a part which protrudes upward from the bottom plate part 12 so as to contact the counterpart terminal of the electric wire connector 101. Moreover, as mentioned above, the substrate connection part 52 is a part which protrudes downward from the bottom plate part 12 and is inserted into the through hole formed on the surface of a substrate (not illustrated) so as to be electrically connected via soldering, etc. Wiring (not illustrated) is connected to each through hole, with each terminal 51 thereby conducted with the corresponding wiring of the substrate. Note that in the present embodiment, each terminal 51 is moved relative to the housing 11 from upward to downward, while the holding part 53 is relatively pressed into the terminal press-in hole 13 from upward to downward.

The holding part 53 includes a terminal side first seal part 55*a* formed in the vicinity of the lower end thereof, a terminal side second seal part 55*b* in the vicinity of the upper end thereof, and an anchor part 56 formed between the terminal side first seal part 55*a* and the terminal side second seal part 55*b*. Note that if the terminal side first seal part 55*a* and the terminal side second seal part 55*b* are comprehensively described, they are described as a terminal side seal part 55. It should be noted that in FIGS. 6A and 6B, the terminal side seal part 55 is hatched, with this hatching only applied for convenience of description.

Moreover, the terminal press-in hole 13 includes a housing side first seal part 15*a* formed in the vicinity of the lower end thereof, a housing side second seal part 15*b* formed in the vicinity of the upper end thereof, and an anchored part 16 formed between the housing side first seal part 15*a* and the housing side second seal part 15*b*. Note that if the housing side first seal part 15*a* and the housing side second seal part 15*b* are comprehensively described, they are described as a housing side seal part 15.

In addition, as illustrated in FIG. 4, when the holding part 53 is pressed into the terminal press-in hole 13, the terminal side first seal part 55*a* and the terminal side second seal part 55*b* are respectively adhered to the housing side first seal part 15*a* and the housing side second seal part 15*b* on the side faces of the terminal press-in hole 13 and configure a first seal part 58*a* and a second seal part 58*b* to exert a seal function. Note that if the first seal part 58*a* and the second seal part 58*b* are comprehensively described, they are described as a seal part 58. The terminal side first seal part 55*a* and the terminal side second seal part 55*b* are held by the housing side first seal part 15*a* and the housing side second seal part 15*b* by a so-called interference fitting. Moreover, the anchor part 56 engages with the anchored part 16 on the side faces of the terminal press-in hole 13, such that the holding part 53 is more assuredly held by the terminal press-in hole 13. Note that a fine recess 13*b* is formed on the periphery of the holding part 53 at the upper end of this terminal press-in hole 13. That is, the fine recess 13*b* is formed so as to be adjacent to the upper end of the second seal part 58*b*.

The anchor part 56 has a protrusion part 56*a* which protrudes more externally in the width direction (Y axis direction) than a side face part 56*b*. As a result, when the holding part 53 is pressed into the terminal press-in hole 13, with the anchor part 56 engaging with the anchored part 16, the protrusion part 56*a* bites a side face part 16*b* of the anchored part 16, consequently engaging with a recess 16*a* formed on this side face part 16*b*. Therefore, the anchor part 56 is assuredly held by the anchored part 16. Moreover, the anchor part 56 has an end part 56*c* extending in the width direction at the lower end thereof, wherein the end part 56*c* faces the end part 16*c* of the anchored part 16 with the anchor part 56 engaging with the anchored part 16. A gap 13*a* is formed between the end part 56*c* of the anchor part 56 and the end part 16*c* of the anchored part 16. That is, the gap 13*a* is formed so as to be adjacent to the upper end of the first seal part 58*a*.

Moreover, as illustrated in FIG. 6A, the terminal side first seal part 55*a* is set so as to have the smallest (narrowest) dimension in the width direction (Y axis direction) in the holding part 53, while the terminal side second seal part 55*b* is set so as to have the largest (widest) dimension in the width direction in the holding part 53, as well as in the overall terminal 51. Further, as illustrated in FIG. 6C, the terminal side first seal part 55*a* is set so as to have the same dimension in the thickness direction (X axis direction) as that in the anchor part 56, while the terminal side second seal part 55*b* is set so as to have the largest (thickest) dimension in the thickness direction in the holding part 53, as well as in the overall terminal 51. Note that the dimensions in the width direction and the thickness direction of the substrate connection part 52 are smaller than those of the terminal side first seal part 55*a*.

In contrast, the housing side first seal part 15*a* is set so as to have the smallest (narrowest) dimension in the width direction in the terminal press-in hole 13, while the housing side second seal part 15*b* is set so as to have the largest (widest) dimension in the width direction in the terminal press-in hole 13. Moreover, as illustrated in FIG. 5B, the housing side first seal part 15*a* is set so as to have the smallest (thinnest) dimension in the thickness direction (X axis direction) in the terminal press-in hole 13, while the housing side second seal part 15*b* has the same dimension in the thickness direction as that in the anchored part 16, in addition to having the largest (thickest) dimension in the terminal press-in hole 13.

Consequently, the terminal 51 is moved relative to the terminal press-in hole 13 from upward to downward, such that the holding part 53 can be smoothly pressed into the terminal press-in hole 13.

In addition, when the holding part 53 is pressed into the terminal press-in hole 13, the side faces on both sides in the width direction of the housing side second seal part 15*b* extend below the side faces on both sides in the width direction of the terminal side second seal part 55*b*, while the side faces on both sides in the width direction of the anchor part 56 extend above the side faces on both sides in the width direction of the anchored part 16. Therefore, a gap is formed between the side faces on both sides in the width direction at the boundary part between the housing side second seal part 15*b* and the anchored part 16 and the side faces on both sides in the width direction at the boundary part between the terminal side second seal part 55*b* and the anchor part 56. Moreover, the gap is formed between the side face part 56*b* of the anchor part 56 and the side face part 16*b* of the anchored part 16, excluding the part in which the protrusion part 56*a* bites the side face part 16*b*. Further, the dimensions in the thickness direction of the anchor part 56 are smaller than those in the thickness direction of the anchored part 16, with the gap formed throughout the entire space in the thickness direction between the side face part 56*b* of the anchor part 56 and the side face part 16*b* of the anchored part 16.

Note that each terminal 51 is manufactured by processing an elongated belt metal plate via punching, pressing, etc., with the thickest terminal side second seal part 55*b* having the thickness of the metal plate itself, and the other parts having a thinner thicknesses than the thickness of the metal plate via pressing. Therefore, the surfaces on both sides in the thickness direction of the terminal side second seal part 55*b* serve as unprocessed adhesion surfaces, while the surfaces on both sides in the thickness direction of the terminal side first seal part 55*a*, which are smaller surfaces, serve as processed adhesion surfaces. Consequently, two adhesion surfaces separated from each other in the vertical direction (Z axis direction), that is, the terminal side second seal part 55*b* and the terminal side first seal part 55*a*, can be easily formed.

As illustrated in FIGS. 4, 5A and 5B, when the holding part 53 is pressed into the terminal press-in hole 13 so as to attach the terminals 51 to the housing 11, even if a liquid potting agent is carried from below to the surface of the substrate connection part 52 to rise, because the terminal side first seal part 55*a* is adhered to the housing side first seal part 15*a* in the terminal press-in hole 13 so as to configure the first seal part 58*a*, the potting agent can be prevented from rising. Moreover, if the potting agent passes through the first seal part 58*a* and further rises, because the terminal side second seal part 55*b* is adhered to the housing side second seal part 15*b* in the terminal press-in hole 13 so as to configure the second seal part 58*b*, the potting agent can be prevented from rising. Because the potting agent is thus prevented from rising by two seal parts 58 separated from each other in the vertical direction (Z axis direction), that is, the first seal part 58*a* and the second seal part 58*b*, the potting agent can be effectively prevented from entering the terminal housing section 14*a*.

Moreover, the anchor part 56 and the anchored part 16, which are disposed between the first seal part 58*a* and the second seal part 58*b*, have a gap formed in the thickness direction (X axis direction) and in the width direction (Y axis direction), excluding the part in which the protrusion part 56*a* mates to form the recess 16*a*. As a result, the gap operates as a reservoir part for reserving the potting agent which has entered through the first seal part 58*a*. Therefore, the potting agent can be further effectively prevented from entering the terminal housing section 14*a*.

Note that if the first seal part 58*a* and the second seal part 58*b* are bonded to serve as a single unit, when the holding part 53 is pressed into the terminal press-in hole 13, the distance (in which the surface of the terminal side seal part 55, particularly the surface in the vicinity of the lower end thereof, rubs against the housing side seal part 15) increases, such that a burr formed on the surface of the terminal 51 and generated via plating, etc. is shaved, consequently generating a large amount of burr waste.

However, in the present embodiment, because the first seal part 58*a* and the second seal part 58*b* are separated from each other in the vertical direction, the distance over which the terminal side first seal part 55*a* rubs against the housing side first seal part 15*a* and the distance over which the terminal side second seal part 55*b* rubs against the housing side second seal part 15*b* are shorter than the case in which the first seal part 58*a* and the second seal part 58*b* are bonded to serve as a single unit, resulting in a reduction in the amount of burr generated. Because the amount of burr is small in this manner, the burr waste due to peeling of the burr generated at the first seal part 58*a* is housed in the gap 13*a* formed so as to be adjacent to the upper end of the first seal part 58*a* in order to function as a first burr housing part, while the burr waste due to peeling of the burr generated at the second seal part 58*b* is housed in the fine recess 13*b* formed so as to be adjacent to the upper end of the second seal part 58*b* in order to function as a second burr housing part, making it possible to prevent contamination (in the mating recess 14 of the housing 11, etc.) due to scattering of the burr waste.

Further, as illustrated in FIGS. 5A and 5B, a recess 17 as a reservoir of the potting agent is formed at the bottom face 14*b* (the top surface of the bottom plate part 12) in each terminal housing section 14*a*, with a guide recess 17*a* which connects this recess 17 and the fine recess 13*b* (which is disposed on the periphery of the holding part 53 at the upper end of the terminal press-in hole 13) formed therein. Therefore, even if a liquid potting agent enters the terminal housing section 14*a*, because it flows in the recess 17 from the fine recess 13*b* at the upper end of the terminal press-in hole 13 through the guide recess 17*a*, and is housed in this recess 17, it is not attached to the surface of the contact part 54 of the terminal 51, such that the attachment of an insulating potting agent does not prevent conduction between the contact part 54 of the terminal 51 and the counterpart terminal.

Further, even if a large amount of the potting agent passes through the seal part 58 and enters the terminal housing section 14*a* for some reason, this terminal housing section 14*a* is isolated from the other terminal housing sections 14*a* via partition walls 18 and therefore not attached to the surface of the contact part 54 of the terminal 51 in the other terminal housing section 14*a*.

In this manner, in the present embodiment, the substrate connector 1 includes a terminal 51 along with a housing 11 holding the terminal 51 and is mounted on a substrate with a liquid potting agent applied thereto, wherein the housing 11 includes a mating recess 14 mating with an electric wire connector 101, along with a bottom plate part 12 in which a terminal press-in hole 13 with the terminal 51 pressed therein is formed, wherein the terminal 51 includes a contact part 54 contacting a counterpart terminal of the electric wire connector 101 in the mating recess 14, a substrate connection part 52 which is exposed below the bottom plate part 12 so as to be connected to the substrate, and a holding part 53 housed and held in the terminal press-in hole 13, and wherein the holding part 53 includes a terminal side first seal part 55*a* and a terminal side second seal part 55*b* which respectively configure a first seal part 58*a* and a second seal part 58*b* by adhering to the side faces of the terminal press-in hole 13.

Consequently, the substrate connector 1 has a small, simple configuration, wherein a potting agent can be assuredly prevented from passing and rising between a holding part 53 of a terminal 51 and a terminal press-in hole 13 of a bottom plate part 12 and being attached to a contact part 54 of the terminal 51.

Moreover, the holding part 53 includes an anchor part 56 which includes a protrusion part 56*a* that bites the side faces of the terminal press-in hole 13 between the first seal part 58*a* and the second seal part 58*b*. Therefore, the holding part 53 is assuredly held by the terminal press-in hole 13, while a potting agent can be effectively prevented from passing and rising between the bottom plate part 12 of the terminal 51 and the terminal press-in hole 13 of the holding part 53.

Further, the terminal side first seal part 55*a* and the terminal side second seal part 55*b* are held in the terminal press-in hole 13 by interference fitting. Therefore, the holding part 53 is assuredly held by the terminal press-in hole 13, while a potting agent can be more effectively prevented from passing and rising between the bottom plate part 12 of the terminal 51 and the terminal press-in hole 13 of the holding part 53.

Further, the bottom plate part 12 includes the recess 17 formed on the top surface thereof. Therefore, even if the potting agent passes between the holding part 53 of the terminal 51 and the terminal press-in hole 13 of the bottom plate part 12 to rise, the potting agent is housed in the recess 17 and therefore not attached to the contact part 54 of the terminal 51.

Further, the terminal side first seal part 55*a* has smaller dimensions in the width direction and the thickness direction than those of the terminal side second seal part 55*b*, with the holding part 53 pressed into the terminal press-in hole 13 from upward to downward. Therefore, the holding part 53 can be smoothly pressed into the terminal press-in hole 13.

Further, a gap 13*a* is formed so as to be adjacent to the upper end of the first seal part 58*a*, while a fine recess 13*b* is formed so as to be adjacent to the upper end of the second seal part 58*b*. Therefore, the burr waste due to peeling of the burr generated in the first seal part 58*a* is housed in the gap 13*a*, while the burr waste due to peeling of the burr generated in the second seal part 58*b* is housed in the fine recess 13*b*, making it possible to prevent contamination due to scattering of the burr waste.

Next Embodiment 2 will be described. Note that the description of elements having the same structures as those of Embodiment 1 will be omitted but accordingly denoted by the same reference numerals. Furthermore, descriptions of operations and effects that are the same as those of Embodiment 1 will be omitted.

Figure 7:
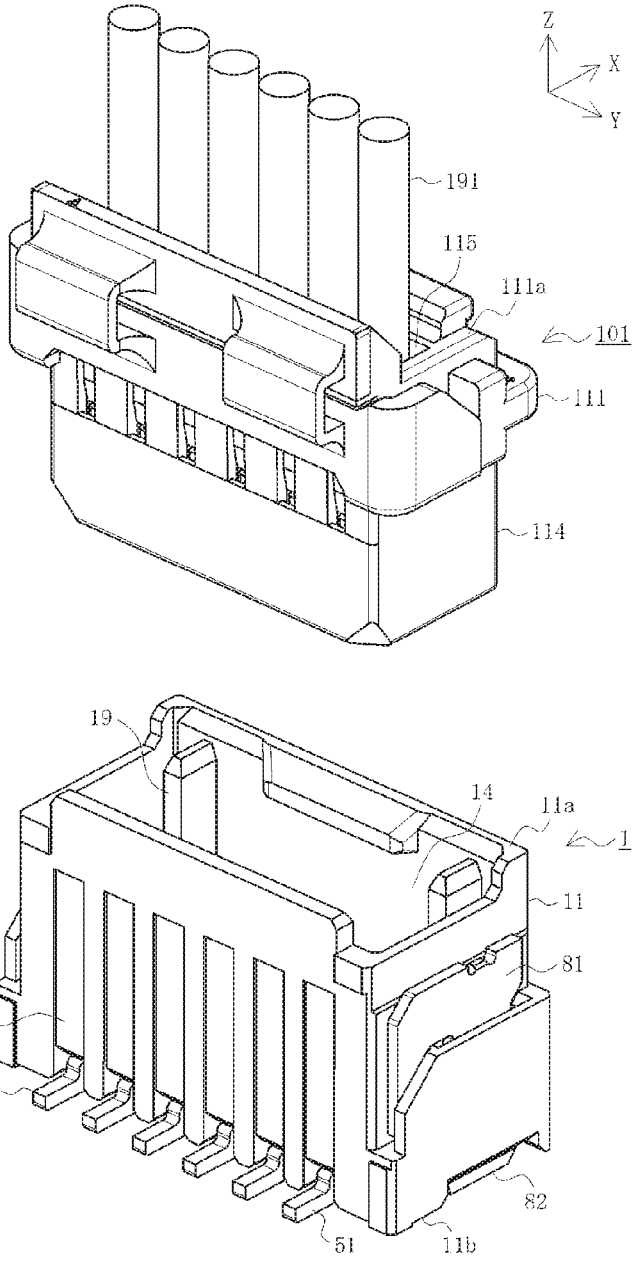
FIG. 7 is a perspective view illustrating the state prior to mating a substrate connector and an electric wire connector according to Embodiment 2.

FIG. 7 is a perspective view illustrating the state prior to mating a substrate connector and an electric wire connector according to Embodiment 2.

In the present embodiment, multiple electric wires 191 are singly arranged so as to form one row extending in the longitudinal direction (Y axis direction) of the substrate connector 1, then connected to the electric wire connector 101. In the example illustrated in the figure, the number of electrical wires 191 is six, but may be changed as desired. In addition, the terminal housing holes 115 of the counterpart housing 111 are arranged so as to form one row extending in the longitudinal direction (Y axis direction) of the counterpart housing 111. Note that the engagement arm part 135 is omitted.

Moreover, the contact parts 54 of the terminal 51 of the substrate connector 1 are arranged so as to form a single row in the longitudinal direction of the substrate connector 1 in the mating recess 14. Note that unlike Embodiment 1, the partition walls 18 are omitted, with the mating recess 14 therefore not divided into multiple terminal housing sections 14*a*. Moreover, the engagement swollen part 35 is omitted in accordance with the omission of the engagement arm part 135 of the counterpart housing 111, while a guide member 19 for guiding the counterpart housing 111 is disposed in the mating recess 14.

Further, in the substrate connector 1 in the present embodiment, a nail 81 as an auxiliary metal fitting is attached to the housing 11. A lower end part 82 of the nail 81 is connected to a connection pad on the surface of a substrate (not illustrated) via soldering, etc. Moreover, the substrate connection part 52 of the terminal 51 is a surface mounting type and protrudes backward (in the X axis negative direction) from below the bottom plate part 12, in addition to being electrically connected to the connection pad formed on the surface of a substrate (not illustrated) via soldering, etc.

Since the other points of the configuration of the electric wire connector 101 according to the present embodiment are the same as in Embodiment 1, descriptions thereof have been omitted.

The configuration of the substrate connector 1 in the present embodiment will hereinafter be described in detail.

Figure 8:
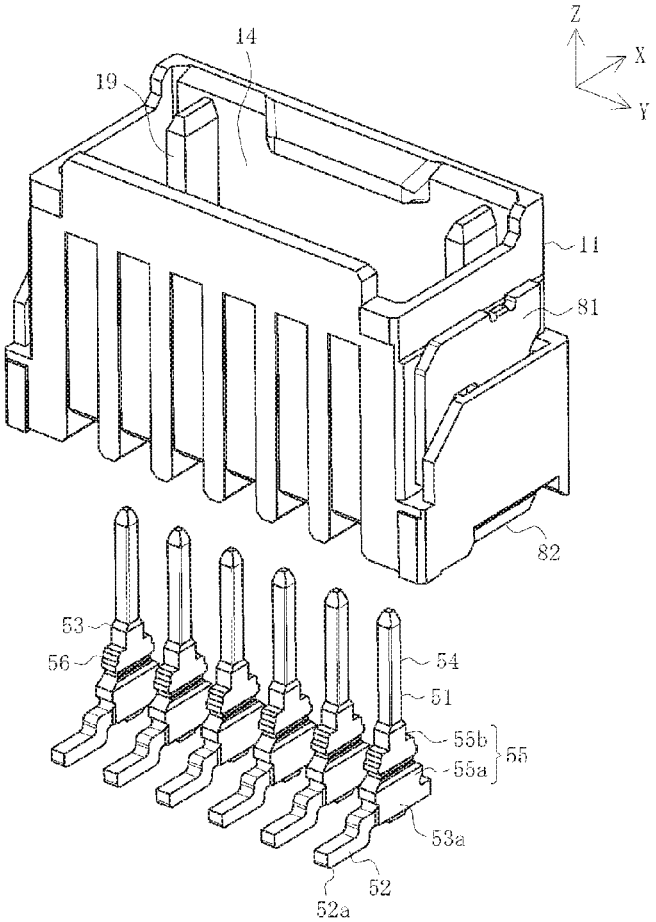
FIG. 8 is an exploded view of the substrate connector according to Embodiment 2.
Figure 9A:
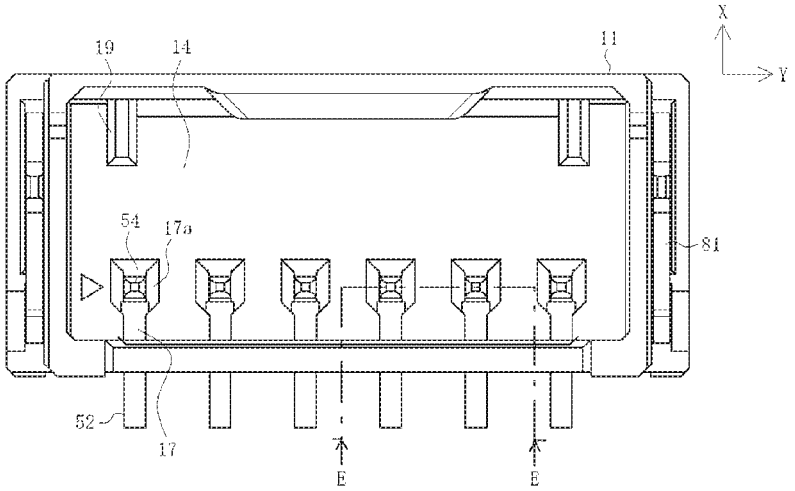
Figure 9B:
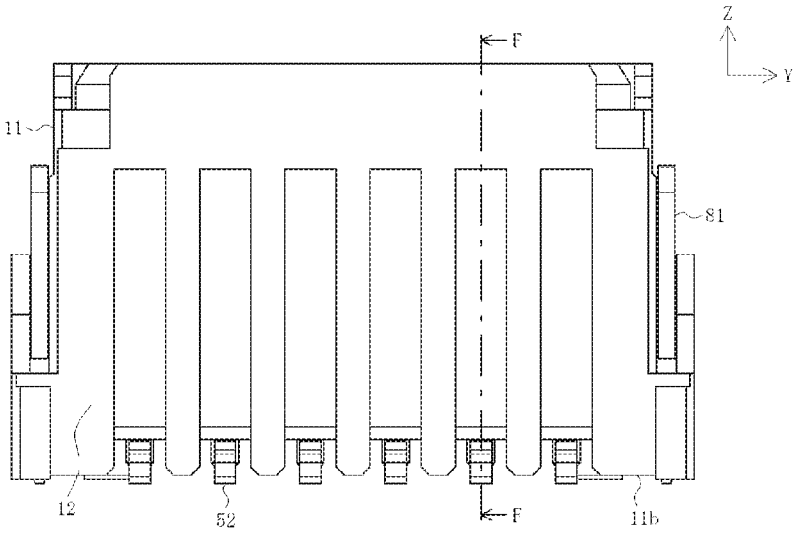
Figure 10B:
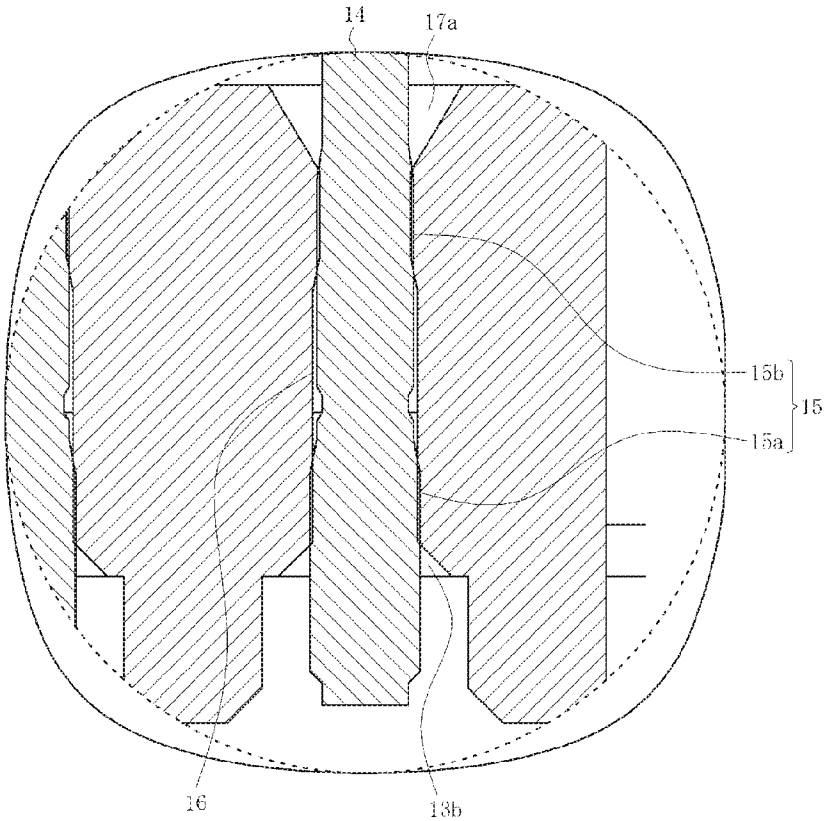
Figure 10A:
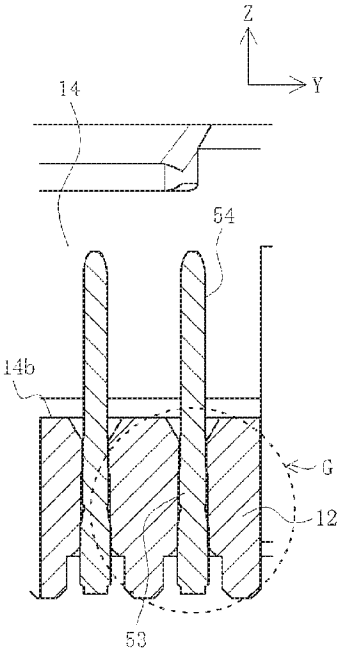
Figure 11:
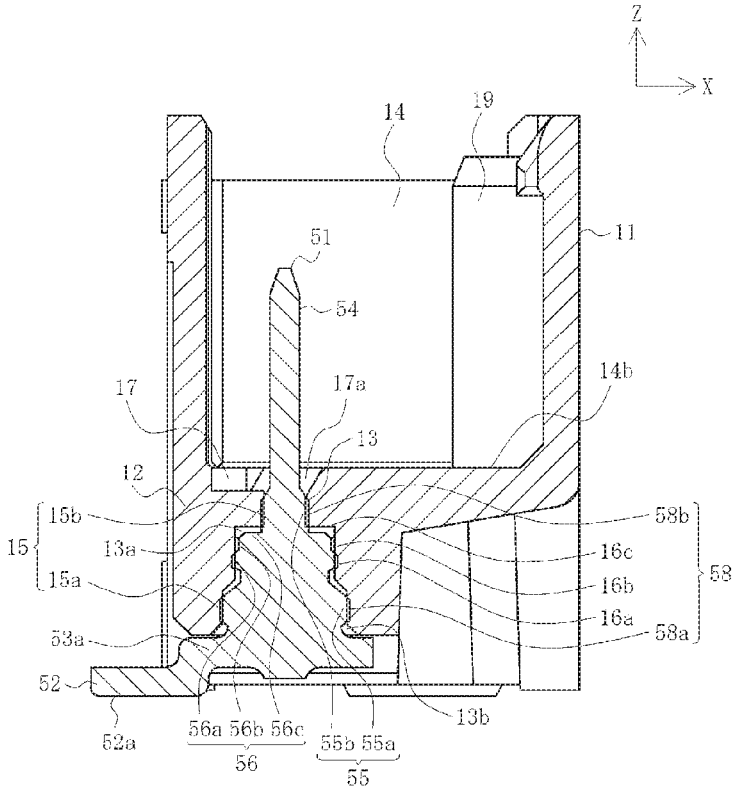
FIG. 11 is a side cross-sectional view of the substrate connector according to Embodiment 2 and is a cross-sectional view in the arrow direction along F-F in FIG. 9B.
Figure 12C:
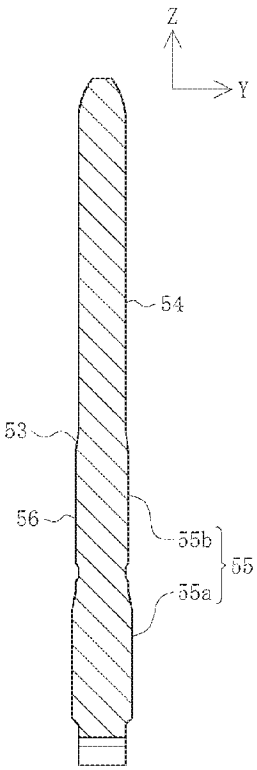
Figure 12B:
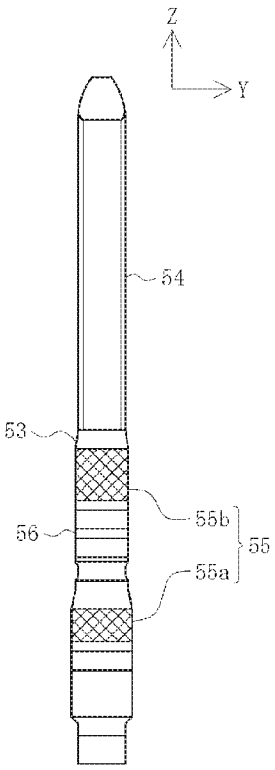
Figure 12A:
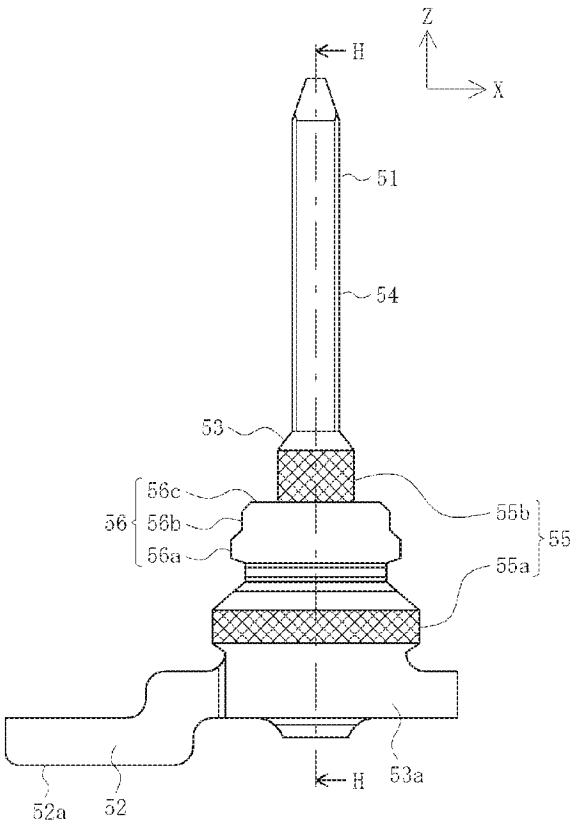
Figure 13:
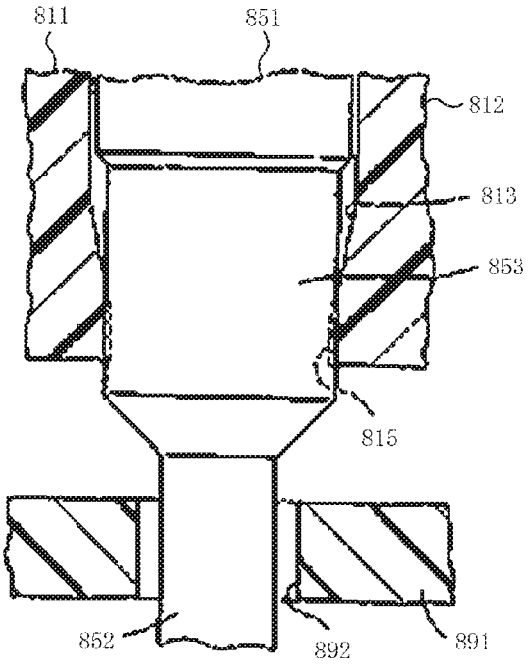
FIG. 13 is a cross-sectional view illustrating a holding part of a terminal in a conventional connector.

FIG. 8 is an exploded view of the substrate connector according to Embodiment 2, FIGS. 9A and 9B are two sided views of the substrate connector according to Embodiment 2, FIGS. 10A and 10B are transverse cross-sectional views of the main parts of the substrate connector according to Embodiment 2, FIG. 11 is a side cross-sectional view of the substrate connector according to Embodiment 2 and is a cross-sectional view in the arrow direction along F-F in FIG. 9B, and FIGS. 12A-12C are three sided views of a terminal of the substrate connector according to Embodiment 2. Note that, in FIGS. 9A and 9B, FIG. 9A is a plan view, while FIG. 9B is a front view, in FIGS. 10A and 10B, FIG. 10A is a cross-sectional view in the arrow direction along E-E in FIG. 9A, while FIG. 10B is an enlarged view of portion G in FIG. 10A, and in FIGS. 12A-12C, FIG. 12A is a side view, FIG. 12B is a front view, and FIG. 12C is a cross-sectional view in the arrow direction along line H-H in FIG. 12A.

As in Embodiment 1, the terminal 51 in the present embodiment is a linear member formed by processing a metal material via punching, pressing, etc., in addition to having a holding part 53 for holding the bottom plate part 12 of the housing 11, along with a contact part 54 stretching linearly upward from the upper end of this holding part 53. Unlike Embodiment 1, this substrate connection part 52 is a surface mounting type which stretches backward (in the X axis negative direction) from below the bottom plate part 12, with the lower surface 52*a* thereof electrically connected to the connection pad formed on the surface of the substrate (not illustrated) via soldering, etc. Therefore, the holding part 53 includes a terminal side first seal part 55*a*, a terminal side second seal part 55*b*, and an anchor part 56, and further includes a connection end part 53*a* connected to the lower end of the terminal side first seal part 55*a*, with the substrate connection part 52 stretching backward from the front end of this connection end part 53*a*.

Moreover, in Embodiment 1, the terminal 51 is moved relative to the housing 11 from upward to downward, while the holding part 53 is relatively pressed into the terminal press-in hole 13 from upward to downward. In contrast, in the present embodiment, the terminal 51 is moved relative to the housing 11 from downward to upward, while the holding part 53 is relatively pressed into the terminal press-in hole 13 from downward to upward.

Therefore, as illustrated in FIG. 12A, the terminal side first seal part 55*a* is set so as to have the largest (widest) dimension in the width direction (X axis direction) of the terminal 51 in the holding part 53, while the terminal side second seal part 55*b* is set so as to have the smallest (narrowest) dimension in the width direction in the holding part 53. Further, as illustrated in FIG. 12C, the terminal side second seal part 55*b* is set so as to have the same dimension in the thickness direction (Y axis direction) of the terminal 51 as that in the anchor part 56, while the terminal side first seal part 55*a* is set so as to have the largest (thickest) dimension in the thickness direction in the holding part 53, as well as in the overall terminal 51. Note that the dimensions in the width direction and the thickness direction of the contact part 54 are smaller than those of the terminal side second seal part 55*b*.

In contrast, the housing side first seal part 15*a* is set so as to have the largest (widest) dimension in the width direction in the terminal press-in hole 13, while the housing side second seal part 15*b* is set so as to have the smallest (narrowest) dimension in the width direction in the terminal press-in hole 13. Moreover, as illustrated in FIG. 10B, the housing side first seal part 15*a* is set so as to have the same dimension in the thickness direction (Y axis direction) as that in the anchored part 16, in addition to having the largest (thickest) dimension in the thickness direction (Y axis direction) in the terminal press-in hole 13, while the housing side second seal part 15*b* is set so as to have the smallest (thinnest) dimension in the thickness direction of the terminal press-in hole 13.

Consequently, the terminal 51 is moved relative to the terminal press-in hole 13 from downward to upward, such that the holding part 53 can be smoothly pressed into the terminal press-in hole 13. It should be noted that in FIGS. 12A and 12B, the terminal side seal part 55 is hatched, with this hatching only applied for convenience of description.

In addition, when the holding part 53 is pressed into the terminal press-in hole 13, the side faces on both sides in the width direction of the housing side first seal part 15*a* extend above the side faces on both sides in the width direction of the terminal side first seal part 55*a*, while the side faces on both sides in the width direction of the anchor part 56 extend below the side faces on both sides in the width direction of the anchored part 16. Therefore, a gap is formed between the side faces on both sides in the width direction at the boundary part between the housing side first seal part 15*a* and the anchored part 16 and the side faces on both sides in the width direction at the boundary part between the terminal side first seal part 55*a* and the anchor part 56. Moreover, the gap is formed between the side face part 56*b* of the anchor part 56 and the side face part 16*b* of the anchored part 16, which excludes the part in which the protrusion part 56*a* bites the side face part 16*b*. Further, the dimensions in the thickness direction of the anchor part 56 are smaller than those in the thickness direction of the anchored part 16, with the gap formed throughout the entire space in the thickness direction between the side face part 56*b* of the anchor part 56 and the side face part 16*b* of the anchored part 16.

Moreover, the anchor part 56 has an end part 56*c* extending in the width direction at the upper end thereof, wherein the end part 56*c* faces the end part 16*c* of the anchored part 16 with the anchor part 56 engaging with the anchored part 16. The gap 13*a* is formed between the end part 56*c* of the anchor part 56 and the end part 16*c* of the anchored part 16. That is, the gap 13*a* is formed so as to be adjacent to the lower end of the second seal part 58*b*. Moreover, the fine recess 13*b* is formed on the periphery of the holding part 53 at the lower end of the terminal press-in hole 13. That is, the fine recess 13*b* is formed so as to be adjacent to the lower end of the first seal part 58*a*.

As illustrated in FIGS. 10A, 10B and 11, when the holding part 53 is pressed into the terminal press-in hole 13 so as to attach the terminal 51 to the housing 11, even if a liquid potting agent is carried from below to the surface of the substrate connection part 52 to rise, because the terminal side first seal part 55*a* is adhered to the housing side first seal part 15*a* on the side faces of the terminal press-in hole 13 so as to configure the first seal part 58*a*, the potting agent can be prevented from rising. Moreover, if the potting agent passes through the first seal part 58*a* and further rises, because the terminal side second seal part 55*b* is adhered to the housing side second seal part 15*b* on the side faces of the terminal press-in hole 13 so as to configure the second seal part 58*b*, the potting agent can be prevented from rising. Because the potting agent is thus prevented from rising by two seal parts 58 separated from each other in the vertical direction (Z axis direction), that is, the first seal part 58*a* and the second seal part 58*b*, the potting agent can be effectively prevented from entering the mating recess 14. The terminal side first seal part 55*a* and the terminal side second seal part 55*b* are held by the housing side first seal part 15*a* and the housing side second seal part 15*b* by a so-called interference fitting.

Moreover, the anchor part 56 and the anchored part 16 disposed between the first seal part 58*a* and the second seal part 58*b* have a narrow gap in the thickness direction (Y axis direction) and the width direction (Y axis direction) of the terminal 51, thereby exerting a seal function to a certain degree. Therefore, the potting agent can be further effectively prevented from entering the mating recess 14.

Note that if the first seal part 58*a* and the second seal part 58*b* are bonded to serve as a single unit, when the holding part 53 is pressed into the terminal press-in hole 13, the distance (in which the surface of the terminal side seal part 55, particularly the surface in the vicinity of the lower end thereof, rubs against the housing side seal part 15) increases, such that a burr formed on the surface of the terminal 51 and generated via plating, etc. is removed, consequently generating a large amount of burr waste.

However, in the present embodiment, because the first seal part 58*a* and the second seal part 58*b* are separated from each other in the vertical direction, the distance over which the terminal side first seal part 55*a* rubs against the housing side first seal part 15*a* and the distance over which the terminal side second seal part 55*b* rubs against the housing side second seal part 15*b* are shorter than the case in which the first seal part 58*a* and the second seal part 58*b* are bonded to serve as a single unit, resulting in a reduction in the amount of burr generated. Because the amount of burr is small in this manner, the burr waste due to peeling of the burr formed at the first seal part 58*a* is housed in the fine recess 13*b* which is formed so as to be adjacent to the lower end of the first seal part 58*a* in order to function as a first burr housing part, while the burr waste due to peeling of the burr formed at the second seal part 58*b* is housed in the gap 13*a* which is formed so as to be adjacent to the lower end of the second seal part 58*b* in order to function as a second burr housing part, making it possible to prevent contamination (in the mating recess 14 of the housing 11, etc.) due to scattering of the burr waste.

Further, as illustrated in FIGS. 9A, 9B and 11, the recess 17 as a reservoir of the potting agent is formed in the vicinity of each terminal press-in hole 13 on the bottom face 14*b* (the top surface of the bottom plate part 12) of the mating recess 14, while the guide recess 17*a* connected to the recess 17 is formed on the periphery of each terminal press-in hole 13. Therefore, even if a liquid potting agent enters the mating recess 14, because it flows in the recess 17 from the guide recess 17*a* on the periphery of the terminal press-in hole 13 and is housed in this recess 17, it is not attached to the surface of the contact part 54 of the terminal 51, such that the attachment of an insulating potting agent does not prevent conduction between the contact part 54 of the terminal 51 and the counterpart terminal.

Note, since the other points of the configuration of the substrate connector 1 according to the present embodiment are the same as in Embodiment 1, descriptions thereof have been omitted.

In this manner, in the present embodiment, the terminal side first seal part 55*a* has larger dimensions in the width direction and the thickness direction than those of the terminal side second seal part 55*b*, with the holding part 53 pressed into the terminal press-in hole 13 from downward to upward. Therefore, the holding part 53 can be smoothly pressed into the terminal press-in hole 13.

Moreover, the fine recess 13*b* is formed so as to be adjacent to the lower end of the first seal part 58*a*, while the gap 13*a* is formed so as to be adjacent to the lower end of the second seal part 58*b*. Therefore, the burr waste due to peeling of the burr generated in the first seal part 58*a* is housed in the fine recess 13*b*, while the burr waste due to peeling of the burr generated in the second seal part 58*b* is housed in the gap 13*a*, making it possible to prevent contamination due to scattering of the burr waste.

Note, since the other points of the operations and effects of the substrate connector 1 according to the present embodiment are the same as in Embodiment 1, descriptions thereof have been omitted.

Moreover, the present disclosure is only one example, with any appropriate changes that preserve the gist of the present disclosure and that can easily be conceived by a person skilled in the art being within the scope of the present disclosure. The widths, thicknesses, and shapes of the portions illustrated in the drawings are schematically illustrated and are not intended to limit the interpretation of the present disclosure.

Further, the disclosure of the present specification describes characteristics related to a preferred and exemplary embodiment. Various other embodiments, modifications, and variations within the scope and spirit of the claims appended hereto could naturally be conceived of by persons skilled in the art by summarizing the disclosures of the present specification.

The invention claimed is:

1. A connector, comprising:

a terminal; and a housing holding the terminal, the connector configured to be mounted on a substrate, wherein the housing includes a mating recess configured to be mated with a counterpart connector, along with a bottom plate part in which a terminal press-in hole with the terminal pressed therein is formed, the terminal includes a contact part configured to contact a counterpart terminal of the counterpart connector in the mating recess, a substrate connection part which is exposed below the bottom plate part, the substrate connection part configured to be connected to the substrate, and a holding part housed and held in the terminal press-in hole, the holding part includes a terminal side first seal part and a terminal side second seal part which respectively configure a first seal part and a second seal part by adhering to the side faces of the terminal press-in hole, wherein the terminal side first seal part has larger dimensions in the width direction and the thickness direction than those of the terminal side second seal part, with the holding part pressed into the terminal press-in hole from downward to upward.

2. The connector according to claim 1, wherein the holding part includes an anchor part which includes a protrusion part that bites the side faces of the terminal press-in hole between the first seal part and the second seal part.

3. The connector according to claim 1, wherein the terminal side first seal part and the terminal side second seal part are held in the terminal press-in hole by interference fitting.

4. The connector according to claim 1, wherein a first burr housing part is formed so as to be adjacent to the lower end of the first seal part, while a second burr housing part is formed so as to be adjacent to the lower end of the second seal part.

5. A connector assembly, comprising:

the connector according to claim 1; and a counterpart connector which mates with the connector.

6. The connector according to claim 1, wherein the connector is configured to be mounted on a substrate with a liquid potting agent applied thereto.

7. The connector according to claim 6, wherein the bottom plate part includes a reservoir formed on a top surface thereof for receiving the potting agent.

8. A connector, comprising:

a terminal; and a housing holding the terminal, the connector configured to be mounted on a substrate, wherein the housing includes a mating recess configured to be mated with a counterpart connector, along with a bottom plate part in which a terminal press-in hole with the terminal pressed therein is formed, the terminal includes a contact part configured to contact a counterpart terminal of the counterpart connector in the mating recess, a substrate connection part which is exposed below the bottom plate part, the substrate connection part configured to be connected to the substrate, and a holding part housed and held in the terminal press-in hole, the holding part includes a terminal side first seal part and a terminal side second seal part which respectively configure a first seal part and a second seal part by adhering to the side faces of the terminal press-in hole, wherein the terminal side first seal part has an upper end and a lower end, and wherein the terminal side first seal part has a constant thickness and a constant width between the upper and lower ends thereof, and wherein the terminal side second seal part has an upper end and a lower end, and wherein the terminal side second seal part has a constant thickness and a constant width between the upper and lower ends thereof.

9. The connector according to claim 8, wherein the holding part includes an anchor part positioned between the terminal side first seal part and the terminal side second seal part.

10. The connector according to claim 9, wherein the anchor part has an upper end and a lower end, and wherein the anchor part has a constant thickness between the upper and lower ends thereof.

11. The connector according to claim 10, wherein the constant thickness of the anchor part is equal to the constant thickness of the terminal side first seal part, and wherein the constant thickness of the anchor part is smaller than the constant thickness of the terminal side second seal part.

12. The connector according to claim 10, wherein the constant thickness of the anchor part is equal to the constant thickness of the terminal side second seal part, and wherein the constant widthickness th of the anchor part is smaller than the constant thickness of the terminal side first seal part.

13. The connector according to claim 8, wherein the constant thickness of the terminal side first seal part is greater than the constant thickness of the terminal side second seal part.

14. The connector according to claim 13, wherein the holding part includes an anchor part positioned between the terminal side first seal part and the terminal side second seal part.

15. The connector according to claim 9, wherein the anchor part has a thickness, the thickness of the anchor being less than the constant thickness of the terminal side first seal part and greater than the constant thickness of the terminal side second seal part.

16. The connector according to claim 8, wherein the constant thickness of the terminal side first seal part is less than the constant thickness of the terminal side second seal part.

17. The connector according to claim 16, wherein the holding part includes an anchor part positioned between the terminal first seal part and the terminal side second seal part.

18. The connector according to claim 17, wherein the anchor part has a thickness, the thickness of the anchor being greater than the constant thickness of the terminal side first seal part and less than the constant thickness of the terminal side second seal part.

19. The connector according to claim 8, wherein the terminal side first seal part and the terminal side second seal part are held in the terminal press-in hole by interference fitting.

20. A connector assembly, comprising:

the connector according to claim 8; and a counterpart connector which mates with the connector.

21. The connector assembly according to claim 8, wherein the connector is configured to be mounted on a substrate with a liquid potting agent applied thereto.

22. The connector according to claim 21, wherein the bottom plate part includes a reservoir formed on a top surface thereof for receiving the potting agent.

* * * * *